US005309332A

United States Patent [19]

Evans et al.

[11] Patent Number: 5,309,332

[45] Date of Patent: May 3, 1994

[54] LIGHT TABLE QUILTING/CRAFT SYSTEM

[76] Inventors: Majorie L. Evans; John R. Evans, both of 25725 N. Player Dr., Valencia, Calif. 91355

[21] Appl. No.: 962,834

[22] Filed: Oct. 19, 1992

Related U.S. Application Data

[63] Continuation-in-part of Ser. No. 810,919, Dec. 20, 1991.

[51] Int. Cl.[5] ..... G09F 13/04

[52] U.S. Cl. ..... 362/97; 24/462; 108/23

[58] Field of Search ..... 362/90, 97; 108/23, 108/90; 24/462

[56] References Cited

U.S. PATENT DOCUMENTS

| | | | |
|---|---|---|---|
| 2,629,432 | 2/1953 | Hanslick | 24/462 |
| 3,019,331 | 1/1962 | Geist | 362/97 |
| 3,811,212 | 5/1974 | Wright | 362/97 |
| 4,116,563 | 9/1978 | Kaufman | 108/23 |
| 4,194,312 | 3/1980 | Conners et al. | 24/462 |
| 4,231,141 | 11/1980 | Derrick et al. | 24/462 |

FOREIGN PATENT DOCUMENTS

| | | | |
|---|---|---|---|
| 0253491 | 9/1926 | United Kingdom | 362/97 |

*Primary Examiner*—Richard A. Bertsch
*Assistant Examiner*—Michael I. Kocharov
*Attorney, Agent, or Firm*—Kelly, Bauersfeld & Lowry

[57] ABSTRACT

A light table is used in connection with an underlying portable light source to illuminate a pattern disposed between the light table and an overlying fabric sheet. The light table includes a portable frame which spaces a translucent upper plate from a lower supporting surface over the light source. The frame also includes a downwardly facing peripheral frame channel which is utilized to clamp the overlying fabric sheet to the light table. More particularly, a plurality of resilient, one-piece hold-down clamps are placed about the periphery of the light table to firmly hold portions of the fabric sheet to the table to minimize relative movement therebetween. The clamps include a lower bracket bent into a resilient arch. The clamps snap into place about the periphery of the light table such that the arch-like lower bracket cooperates with the peripheral frame channel.

8 Claims, 1 Drawing Sheet

FIG. 1
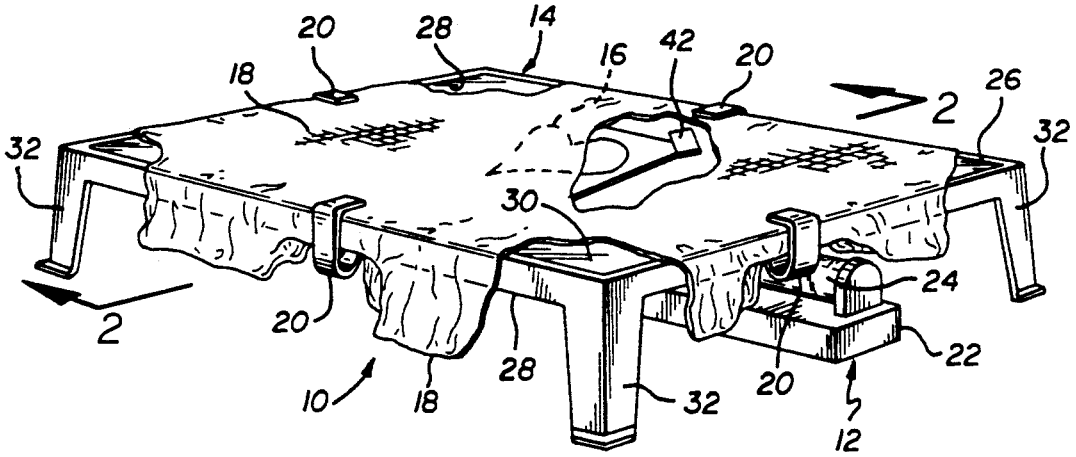
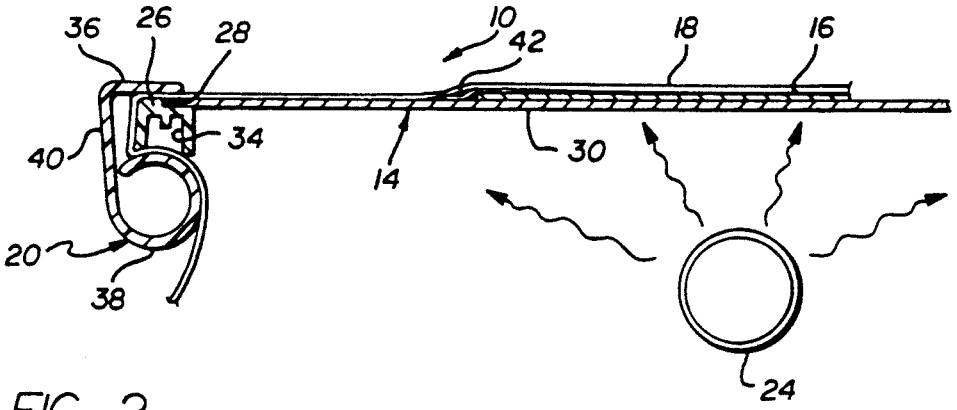
FIG. 2
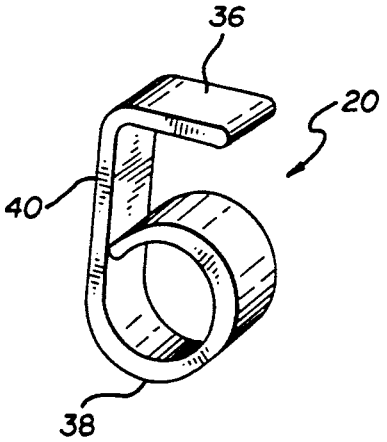
FIG. 3

LIGHT TABLE QUILTING/CRAFT SYSTEM

RELATED APPLICATION

This is a continuation-in-part of U.S. patent application Ser. No. 07/810,919, filed Dec. 20, 1991 and entitled TABLE HAVING TRANSLUCENT UPPER SURFACE.

BACKGROUND OF THE INVENTION

This invention relates generally to light tables. More particularly, the present invention relates to a portable light table and an associated quilting/craft system utilized to apply a design to a fabric sheet.

Light tables have been used extensively by draftsmen and artists to facilitate the preparation of drawings and in the application of designs to an overlying material, such as paper or fabric. Light tables are very popular with artists desiring to carefully copy a pattern from one substrate material onto a sheet of fabric.

Prior light tables utilized in connection with fabric sheets are typically heavy, of relatively complicated construction and expensive. Such prior light tables usually combine the table and the light into a single unit, and include a translucent or transparent upper surface over which a pattern may be placed and disposed between the upper surface and an overlying fabric sheet. When the light bulb is turned on, the pattern is clearly visible through the fabric sheet, which permits one to trace the pattern and/or apply decorative materials to the fabric sheet in accordance with the pattern, as desired.

One primary drawback with prior light tables is the inability to anchor the fabric sheet to the light table in a manner minimizing or preventing relative movement between the two. Another problem lies in the sheer bulk of prior light tables, which makes it difficult to carry them from room to room or from one remote location to another over an extended period of time.

Accordingly, there has been a need for a novel light table quilting/craft system which is economical to produce, efficient, and which can be used in connection with a portable light source. Such a novel light table quilting/craft system should lend itself to being manufactured of a variety of lightweight, strong materials which permit the light table itself to be moved with ease and without fear of breakage. Additionally, a light table is desirable which may be nested with other similar tables to facilitate transportation and storage thereof. Moreover, there is a need for means for non-destructively clamping a fabric sheet to the light table to minimize relative movement therebetween. The present invention fulfills these needs and provides other related advantages.

SUMMARY OF THE INVENTION

The present invention resides in an improved light table quilting/craft system which is lightweight, easy to manufacture, and can be used with a variety of light sources. The light table quilting/craft system comprises a portable light source placed over a generally planar supporting surface, and a light table having a translucent upper surface. The light table stands atop the supporting surface to position the translucent upper surface over the light source. A pattern is placed over the translucent upper surface, and a fabric sheet is draped over the pattern and the upper surface of the light table. Means are provided for non-destructively clamping the fabric sheet to the light table to minimize relative movement therebetween.

In a preferred form of the invention, the light source extends the length of the light table, and the pattern is fixed to the upper surface of the light table with a removable adhesive. The light table includes a portable frame having a large central window, and a translucent plate disposed within the window. A plurality of legs extend downwardly from the translucent plate for supporting the light table over the planar surface. The legs are of sufficient length to permit the light source to be placed between the underlying supporting surface and the translucent plate. The frame further includes a downwardly facing peripheral channel which cooperates with the clamping means to help retain the clamping means in place on the light table.

The clamping means comprise a plurality of one-piece, resilient hold-down clamps which are configured to snap into place within the peripheral channel to securely hold the fabric sheet in a selected position over the upper surface of the light table. The hold-down clamps each include an upper bracket for engaging an upper surface of the light table, a lower bracket configured to engage the peripheral frame channel and rest partially therein, and an intermediate portion extending between the upper and lower brackets. The lower bracket is bent into a resilient arch having sufficient flexibility to securely hold fabric sheets of varying thicknesses in place.

The light table quilting/craft system of the present invention lends itself well to a novel method for applying a design to a fabric sheet. This method comprises the steps of placing a light table having a translucent upper surface over a portable light source, and securing a pattern to the upper surface of the light table. The step of placing the light table over the portable light source includes the step of permitting the light source to be removed from beneath the light table without disturbing the positioning of the light table over a supporting surface. The pattern is preferably secured to the upper surface of the light table by means of a removable adhesive.

The method steps further include covering the pattern and the upper surface of the light table with a fabric sheet, clamping the fabric sheet to the light table to prevent or eliminate relative movement therebetween, and applying a design corresponding to the pattern to an upper surface of the fabric sheet. The clamping step here mentioned involves the use of a plurality of the resilient, one-piece hold-down clamps placed about the periphery of the light table over the fabric sheet.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 1 is a top, front and left side perspective view of a light table quilting/craft system embodying the invention, wherein the corner portions of a fabric sheet overlying the light table have been broken away for clarity;

FIG. 2 is an enlarged, fragmented sectional view taken generally along the line 2—2 of FIG. 1, illustrating the manner in which a hold-down clamp is utilized to secure the fabric sheet to a frame of the light table, and further illustrating the positioning of a pattern between the fabric sheet and an underlying translucent plate; and FIG. 3 is an enlarged perspective view of the hold-down clamps illustrated in FIGS. 1 and 2.

DETAILED DESCRIPTION OF THE PREFERRED EMBODIMENT

As shown in the drawings for purposes of illustration, the present invention is concerned with an improved light table quilting/craft system, generally designated in FIG. 1 by the reference number 10. In accordance with the present invention, the light table quilting/craft system 10 comprises a portable light assembly 12, a light table 14 positioned over the light assembly, a pattern 16 resting atop the light table, and a fabric sheet 18 draped over the pattern and the light table. A plurality of resilient hold-down clamps 20 provide means for non-destructively clamping the fabric sheet 18 to the light table 14 to minimize relative movement therebetween.

The portable light assembly 12 shown in the accompanying drawings comprises a casing 22 and a supported fluorescent light bulb 24. The light bulb 24 is of sufficient length to extend the length of the light table 14 to fully illuminate the pattern 16 beneath the fabric sheet 18.

The light table 14 is constructed to include a lightweight frame 26 preferably constructed of a resilient-yet-rigid plastic material. The frame itself includes a large central window 28 wherein is positioned a translucent plate 30. The translucent plate 30 provides the upper surface for the light table 14 and directly supports the pattern 16. The frame further includes four legs 32 which extend downwardly from the upper translucent plate 30 for supporting the light table 14 over a planar surface, such as a tabletop or desk top. The legs 32 are of sufficient length to permit the light assembly 12 to be placed between the underlying supporting surface and the upper translucent plate 30.

As illustrated best in FIG. 2, the frame is constructed to include a downwardly facing peripheral channel 34. This channel 34 cooperates with the clamps 20 to help retain the fabric sheet 18 in place over the upper translucent plate 30.

The pattern 16 illustrated in FIGS. 1 and 2 is simply a sheet of transparent or translucent paper having an opaque heart-shaped design. The opaque design on the pattern 16 is visible through the fabric sheet 18 when the light bulb 24 is illuminated, to enable a user of the quilting/craft system 10 to either trace the pattern onto an upper surface of the fabric sheet 18, or to apply one of a wide variety of craft materials to the fabric sheet 18 utilizing the opaque pattern as a guide.

The fabric sheet 18 should not be so thick so as to prevent light from passing therethrough when the light assembly 12 is turned on. Obviously any material which prevented such light transmission would also prevent the opaque pattern on the pattern 16 to be viewed. The fabric sheet 18 is simply draped over the upper surface of the light table 14 to lay generally in flat surface contact with the translucent plate 30 and the pattern 16.

The resilient hold-down clamps 20 are of a one-piece construction and are configured to snap into place within the peripheral channel 34 to securely hold the fabric sheet 18 in a selected position over the upper surface of the light table 14. The hold-down clamps 20 each include an upper bracket 36 for engaging an upper surface of the light table 14, a lower bracket 38 configured to engage the peripheral frame channel 34 and rest partially therein, and an intermediate portion 40 which extends between the upper and lower brackets (see FIGS. 2 and 3). The lower bracket 38 is bent into a resilient arch having sufficient flexibility to securely hold fabric sheets of various thicknesses in place. Each hold-down clamp 20 includes a first side 20*a* and a second side 20*b*. The first side 20*a* of the upper bracket 36 engages the upper surface of the light table 14, and the second side 20*b* engages the peripheral frame channel 34 and rests partially therein.

To utilize the light table quilting/craft system 10 of the present invention, the light table 14 is placed over the portable light assembly 12, and the pattern 16 bearing a desired opaque design thereon is secured to the upper side of the translucent plate 30. The construction of the light table 14 permits the light assembly 12 to be removed from beneath the light table 14 without disturbing the positioning of the light table over the supporting surface. The pattern 16 is preferably secured to the upper surface of the light table 14 by means of a removable adhesive 42.

The fabric sheet 18 is spread over the pattern 16 and the upper surface of the light table 14, and then the clamps 20 are used to fix the fabric sheet 18 to the light table 14 to minimize relative movement therebetween.

With the pattern 16 and the fabric sheet 18 so positioned over the light table 14, the portable light assembly 12 may be turned on to reveal the opaque design of the pattern through the fabric sheet. A design corresponding to the design of the pattern may be applied to an upper surface of the fabric sheet 18 with confidence that neither the pattern 16 nor the fabric sheet 18 will accidentally move out of position as the design is being applied.

From the foregoing it is to be appreciated that the novel light table quilting/craft system of the present invention incorporates a novel light table design capable of being used with a variety of light sources. By constructing the light table 14 of a hard, resilient plastic material, the light table is virtually unbreakable and yet is easily manufactured in a manner permitting multiples of such tables to be nestable with respect to one another to thus minimize transportation and storage costs. The clamps hold the fabric sheet 18 in place while a user traces a design from the pattern 16 onto the upper surface of the fabric sheet, and further allows one to move an unfinished project without disturbing the positioning of the fabric sheet 18 over the pattern 16 and the translucent plate 30. Moreover, the light table 14 of the present invention may be turned upside down to conveniently carry craft supplies to class or to another room.

Although a particular embodiment of the invention has been described in detail for purposes of illustration, various modifications may be made without departing from the spirit and scope of the invention. Accordingly, the invention is not to be limited, except as by the appended claims.

We claim:

1. A light table quilting/craft system, comprising:

a portable light source placed over a generally planar supporting surface;

a light table having a translucent upper surface, the light table standing atop the supporting surface to position the translucent upper surface over the light source, the light table including a portable frame having a large central window and a downwardly facing peripheral channel, a translucent plate disposed within the window, and a plurality of legs extending downwardly from the translucent plate for supporting the light table over the planar surface;

a pattern placed over the translucent upper surface;

a fabric sheet draped over the pattern and the upper surface of the light table; and means for non-destructively clamping the fabric sheet to the light table to minimize relative movement therebetween, the clamping means including a plurality of one-piece, resilient hold-down clamps which each include a first side and a second side and are bent into a shape to include an upper bracket whereat the first side engages an upper surface of the light table, and a lower bracket wherein the second side engages the peripheral frame channel and rests partially therein, wherein the lower bracket is bent into a resilient arch having sufficient flexibility to securely hold fabric sheets of various thicknesses in place.

2. A light table quilting/craft system as set forth in claim 1, wherein the legs are of sufficient length to permit the light source to be removably placed between the underlying supporting surface and the translucent plate.

3. A light table quilting/craft system as set forth in claim 1, wherein the hold-down clamps each further include an intermediate portion extending between the upper and lower brackets.

4. A light table quilting/craft system as set forth in claim 1, wherein a light source extends the length of the light table.

5. A light table for use in connection with a separately positionable underlying light source to illuminate a pattern disposed between the light table and an overlying fabric sheet, the light table comprising:

a portable frame having a large central window;

a translucent upper plate fixed to the frame to fill the central window, wherein the translucent plate forms a translucent upper surface for the light table; and a plurality of one-piece, resilient hold-down clamps configured to snap into place relative to the frame to securely hold the fabric sheet in a selected position over the upper surface of the light table;

wherein the portable frame includes a plurality of legs extending downwardly from the translucent upper plate for supporting the light table over a planar support surface, and a downwardly facing peripheral frame channel which cooperates with the hold-down clamps to help retain the clamps in place on the table, and wherein each hold-down clamp includes a first side and a second side and is bent into a shape to include an upper bracket whereat the first side engages the upper surface of the light table, and a lower bracket wherein the second side engages the peripheral frame channel and rests partially therein, wherein the lower bracket is bent into a resilient arch having sufficient flexibility to securely hold fabric sheets of various thicknesses in place.

6. A light table as set forth in claim 5, wherein the hold-down clamps each include an intermediate portion extending between the upper and lower brackets.

7. A light table as set forth in claim 5, wherein the legs are of sufficient length to permit the light source to be placed between the underlying support surface and the translucent plate.

8. A light table quilting/craft system, comprising:

a light table having a translucent upper surface and standing atop a generally planar supporting surface, the light table including a frame having a large central window, a translucent plate disposed within the window, and a plurality of legs extending downwardly from the translucent plate for supporting the light table over the planar surface, wherein the frame includes a downwardly facing peripheral channel;

a portable light source removably placed over the planar supporting surface and beneath the translucent upper surface;

a pattern placed over the translucent upper surface;

a fabric sheet draped over the pattern and the upper surface of the light table; and means for non-destructively clamping the fabric sheet to the light table to minimize relative movement therebetween, the clamping means including a plurality of one-piece, resilient hold-down clamps which are configured to snap into place within the peripheral channel to securely hold the fabric sheet in a selected position over the upper surface of the light table, the hold-down clamps each including a first side, a second side, an upper bracket for engaging an upper surface of the light table, a lower bracket configured to engage the peripheral frame channel and rest partially therein, and an intermediate portion extending between the upper and lower brackets, wherein the lower bracket is bent into a resilient arch having sufficient flexibility to securely hold fabric sheets of various thicknesses in place and is configured such that the first side of the upper bracket engages an upper surface of the light table, and the second side of the lower bracket engages the peripheral frame channel.

* * * * *